166-66 SR
10/22/85 XR 4,548,266

United States Patent [19]
Burklund

[11] Patent Number: 4,548,266
[45] Date of Patent: Oct. 22, 1985

[54] METHOD FOR ISOLATING TWO AQUIFERS IN A SINGLE BOREHOLE

[75] Inventor: Patrick W. Burklund, Livermore, Calif.

[73] Assignee: The United States of America as represented by the United States Department of Energy, Washington, D.C.

[21] Appl. No.: 572,346

[22] Filed: Jan. 20, 1984

[51] Int. Cl.[4] ..... E21B 33/13; E21B 47/06; E21B 49/08

[52] U.S. Cl. ..... 166/250; 166/66; 166/242; 166/264; 166/285; 166/377

[58] Field of Search ..... 166/250, 278, 285, 377, 166/387, 54.1, 64, 66, 113, 229, 242

[56] References Cited

U.S. PATENT DOCUMENTS

| | | | |
|---|---|---|---|
| 1,491,427 | 4/1924 | Smit . | |
| 1,834,946 | 12/1931 | Halliburton | 166/285 |
| 2,007,465 | 7/1935 | Burt | 166/113 X |
| 2,207,345 | 7/1940 | Hammer | 166/285 |
| 2,284,969 | 6/1942 | Adkison . | |
| 2,626,778 | 1/1953 | Lockett | 166/285 |
| 3,372,751 | 3/1968 | Canut . | |
| 3,378,069 | 4/1968 | Fields | 166/66 X |
| 3,454,085 | 7/1969 | Bostock | 166/66 |
| 3,753,464 | 8/1973 | Wilhelm | 166/242 |
| 4,396,075 | 8/1983 | Wood et al. | 166/242 X |

OTHER PUBLICATIONS

Campbell et al., *Water Well Technology,* McGraw-Hill Co., 1973.

Burklund et al., "Method to Avoid Groundwater Mixing between Two Aquifers During Drilling and Well Completion Procedures", UCRL-89440, Jun. 1983.

*Primary Examiner*—George A. Suchfield
*Attorney, Agent, or Firm*—L. E. Carnahan; Roger S. Gaither; Judson R. Hightower

[57] ABSTRACT

A method for isolating and individually instrumenting separate aquifers within a single borehole. A borehole is first drilled from the ground surface, through an upper aquifer, and into a separating confining bed. A casing, having upper and lower sections separated by a coupling collar, is lowered into the borehole. The borehole is grouted in the vicinity of the lower section of the casing. A borehole is then drilled through the grout plug and into a lower aquifer. After the lower aquifer is instrumented, the borehole is grouted back into the lower portion of the casing. Then the upper section of the casing is unscrewed via the coupling collar and removed from the borehole. Finally, instrumentation is added to the upper aquifer and the borehole is appropriately grouted. The coupling collar is designed to have upper right-hand screw threads and lower left-hand screw thread, whereby the sections of the casing can be readily separated.

15 Claims, 8 Drawing Figures

METHOD FOR ISOLATING TWO AQUIFERS IN A SINGLE BOREHOLE

BACKGROUND OF THE INVENTION

The invention described herein arose at the Lawrence Livermore Laboratory in the course of, or under, Contract No. W-7405-ENG-8 between the U.S. Department of Energy and the University of California.

This invention relates to aquifer isolation techniques, and more particular to a method for isolating and instrumenting separate aquifers utilizing a single hole.

Various methods and apparatus have been developed over the years for preventing undesired fluids from entering wells. This is usually accomplished by some means of casing and then cementing or grouting the drill hole, whereafter a hole is drilled through the grouting into the area desired to be penetrated. These prior methods and apparatus are exemplified by U. S. Pat. Nos. 1,491,427 issued Apr. 22, 1924 to J. J. Smit; 2,284,969 issued June 2, 1942 to J. H. Adkison; and 3,372,751 issued Mar. 12, 1968 to A. L. Canut.

In various drilling applications and underground studies, cross migration of waters in separate aquifers must be prevented. The procedure employed heretofore in ground water studies usually involved drilling a separate borehole into each aquifer. In underground water studies, for example, it is necessary to provide each of the separate aquifers with instrumentation without cross migration of groundwater between aquifers. While drilling separate boreholes and installing the needed instrumentation in each borehole has been effective, it has not been efficient and has been costly. Thus, a need has existed for a more efficient and less costly method of providing separate aquifers with instrumentation for groundwater monitoring, especially where the water table is relatively deep.

Therefore, it is an object of this invention to provide a method for isolating and individually instrumenting separate aquifers in a single borehole.

A further object of the invention is to provide a method for installing instrumentation in separated aquifers using a single hole while preventing cross migration of the waters.

Another object of the invention is to provide an effective method of instrumenting a plurality of aquifers, while substantially reducing the cost compared to prior known methods.

Another object of the invention is to provide drilling and well completion procedures for isolating two aquifers in a single borehole.

Other objects of the invention will become readily apparent from the following description and accompanying drawings.

SUMMARY OF THE INVENTION

The above objects and advantages provided by this invention are carried out by drilling and well completion procedures whereby separate aquifers may be instrumented without any cross migration or contamination of the water in the separate aquifers.

The method of this invention basically involves drilling a hole from the ground surface through the upper aquifer and into the geologic bed separating the aquifers, lowering a casing having two sections connected by a coupling into the borehole, grouting the hole up to the vicinity of the coupling, drilling a borehole through the grout and into the lower aquifer. After installing instrumentation in the lower aquifer the borehole is grouted up to the vicinity of the coupling, whereafter the upper section of the casing is uncoupled and removed from the borehole. The upper aquifer is then instrumentated and the borehole is grouted, such that the leads for the instrumentation in each of the aquifers extend to the ground surface, whereby the underground water in each of the aquifers can be monitored.

The coupling for connecting the casing sections is constructed as a flush collar having upper right-hand screw threads and lower left-hand screw threads, so as to provide for easy disconnect between the two sections of the casing.

DETAILED DESCRIPTION OF THE INVENTION

The present invention involves a method for individually instrumenting separate aquifers within a single borehole while isolating the aquifers so as to prevent cross migration of the water of the separate aquifers. By use of a single borehole, the cost of drilling is substantially reduced when compared to the prior methods wherein separate boreholes are drilled into each aquifer and instrumentation installed, since a significant portion of the costs is involved in the drilling operation.

The method of this invention, described hereinafter with respect to FIGS. 1–8 is described in even greater detail, along with cost estimates and experimental verification thereof, in report UCRL-89440 entitled "Method To Avoid Groundwater Mixing Between Two Aquifers During Drilling And Well Completion Procedures" by P. W. Burklund et al dated June, 1983.

The procedure utilized in carrying out this invention employs hybrid drilling methods using continuous flight, hollow stem augering, with drive samples, air-rotary and wire line core drilling with the setting of a temporary casing in the upper aquifer. However, the invention is not limited to any specific drilling methods or specific type of equipment, as it is recognized that different drilling techniques may be required depending on the underground formations through which the borehole is drilled. Also, the invention is not limited to any specific type of instrumentation or grout or to the installation techniques described, since such are set forth for the purpose of example only. The instrumentation and the type of grout will depend on the specific applications and underground conditions for which the invention is being utilized.

Figure 1:
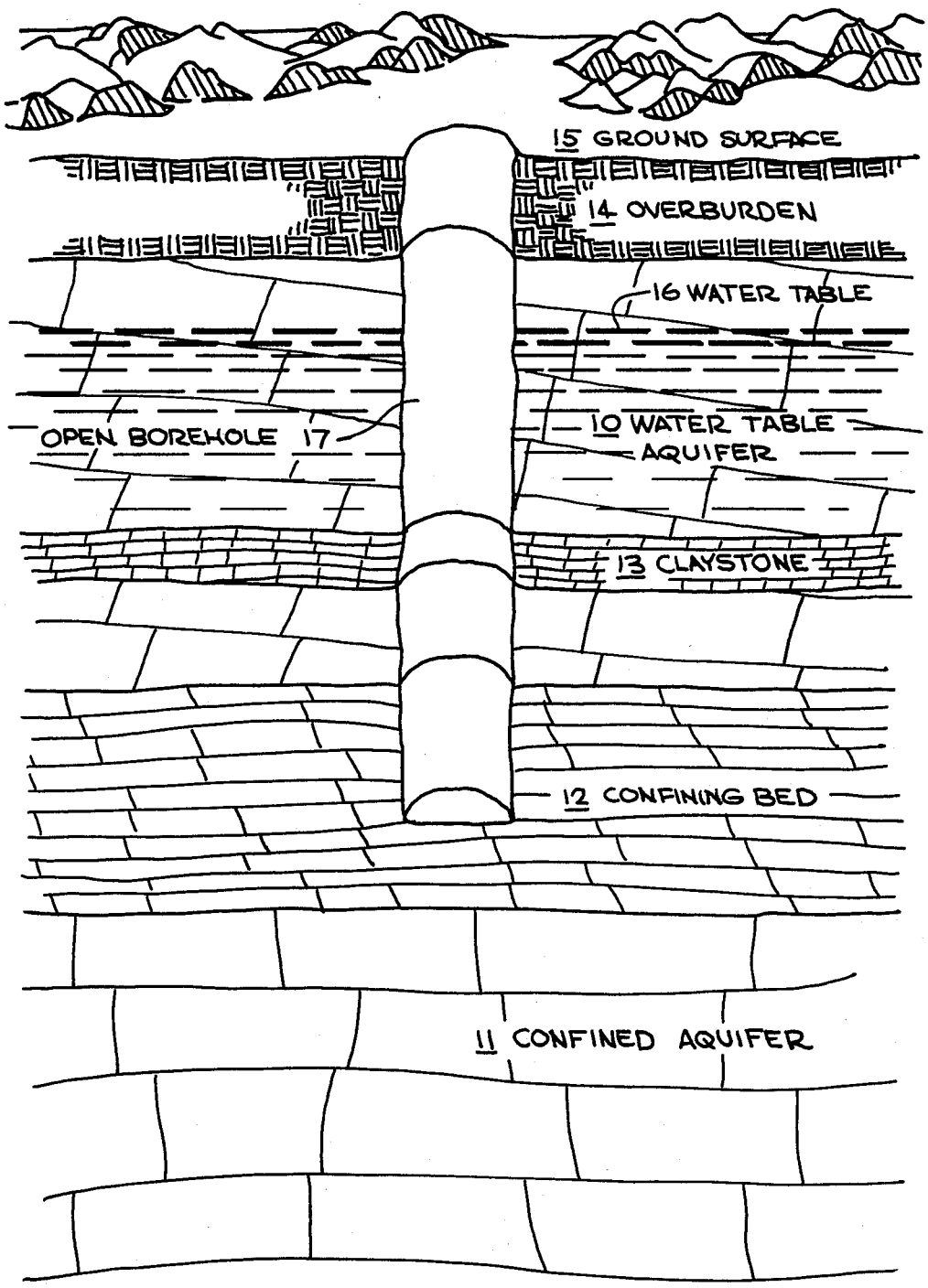
FIGS. 1, 2 and 4–8 illustrate various steps involved in the aquifer isolation and instrumentation method of the present invention.

Reference is now made to FIGS. 1 to 8, wherein an embodiment of the underground formation, equipment, grouting, etc. is illustrated. FIG. 1 shows two separate aquifers, an upper water table aquifer (sandstone) 10 and a lower confined aquifer (sandstone) 11, separated by a confining bed (claystone/siltstone) 12. In this embodiment a layer 13 of claystone is located in the upper aquifer 10, with a layer of overburden 14 extending from ground surface 15 to a water table 16. The first step of the method involves drilling a borehole 17 from the ground surface 15 downwardly through the various layers, including the upper aquifer 10 and into confining bed 12. The borehole 17, may for example, have a 6.75 inch diameter.

Figure 2:
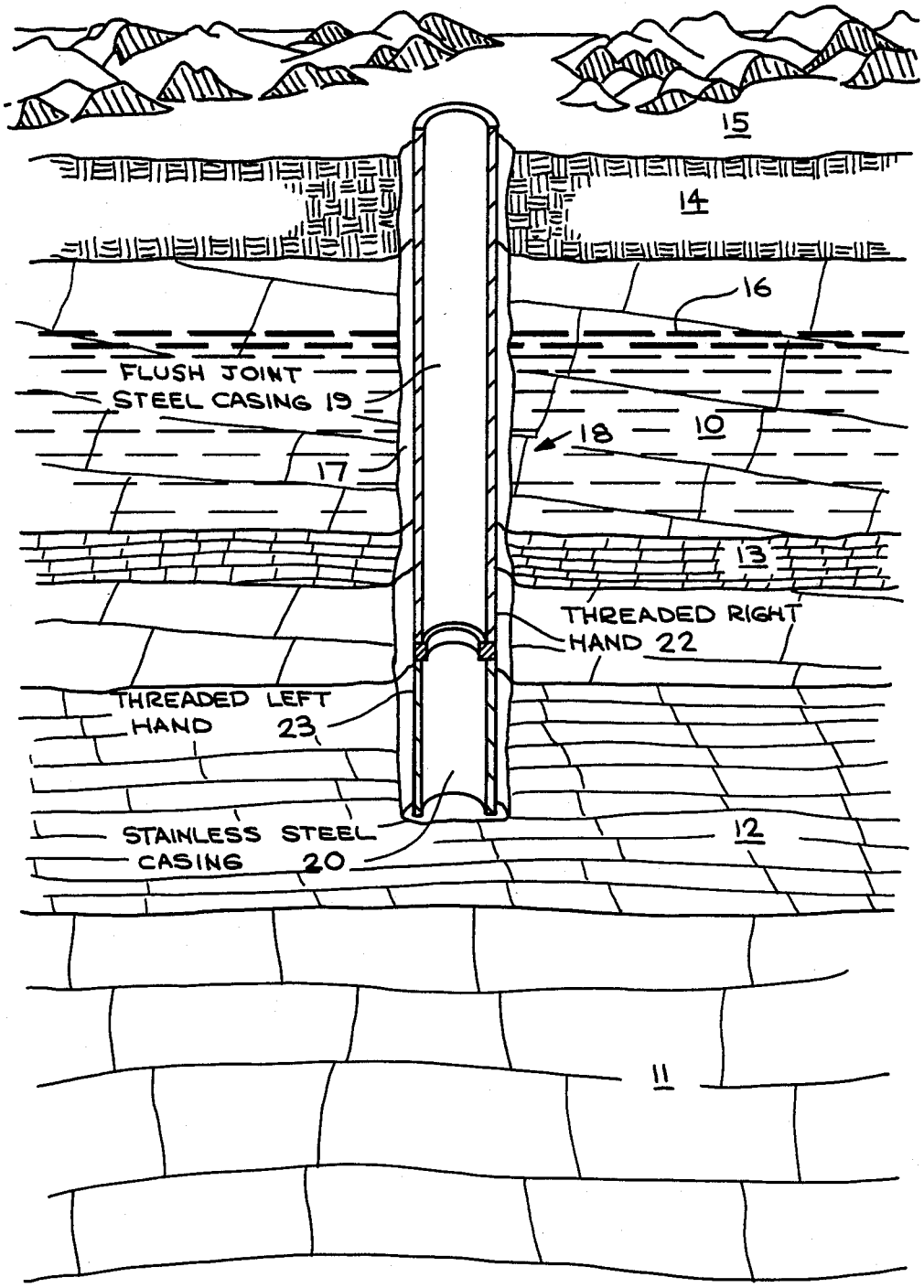

FIG. 2 illustrates the next operational sequence wherein casing generally indicated at 18 is emplaced in borehole 17. Casing 18 comprising a flush joint carbon steel section 19 having a stainless steel section 20 secured at the lower end of section 19 via coupling 21 illustrated in detail FIG. 3. The lower end of casing section 19 is provided with a threaded right hand portion 22, while the upper end of casing section 20 is provided with a threaded left hand portion 23, the purpose for which is described hereinafter. The casing 18 is lowered to within about six inches from the bottom of borehole 17.

Figure 3:
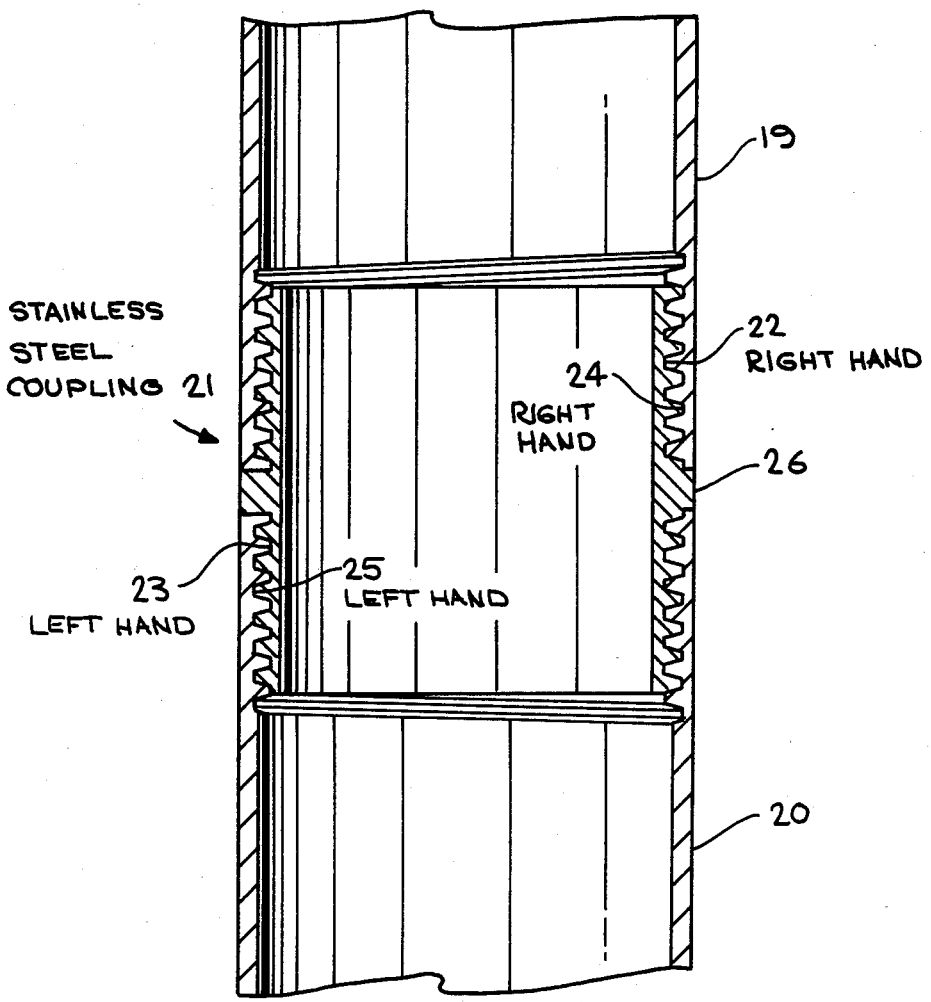
FIG. 3 illustrates an embodiment of the casing and coupling utilized in carrying out the method of this invention.

As shown in FIG. 3, the coupling or flush collar 21, constructed of stainless steel, includes an upper square threaded right hand section 24 and a lower square threaded left hand section 25 separated by an unthreaded center section 26. The threaded portions 22 and 23 of casing sections 19 and 20 are of a square thread configuration to cooperate with sections 24 and 25 of coupling 21. The casing 18, for example, may have a 5 inch outside diameter and a 4.7 inch inside diameter. The upper casing section 19 may be composed of several interconnected casing lengths (20 foot for example), depending on the depth of borehole 17, and the lower casing section 20 having a length of 8 feet, for example.

By way of assembly of the casing 18, the lower stainless steel casing section 20 is threaded hand tight to section 25 of stainless steel coupling 21. The coupling 21 and casing section 20 are then attached to the carbon steel casing section 19 and the coupling 21 is wrench tightened to a first length of casing section 19. All of the remaining lengths of casing section 19 are wrench tightened as the casing 18 is lowered down the borehole 17.

Figure 4:
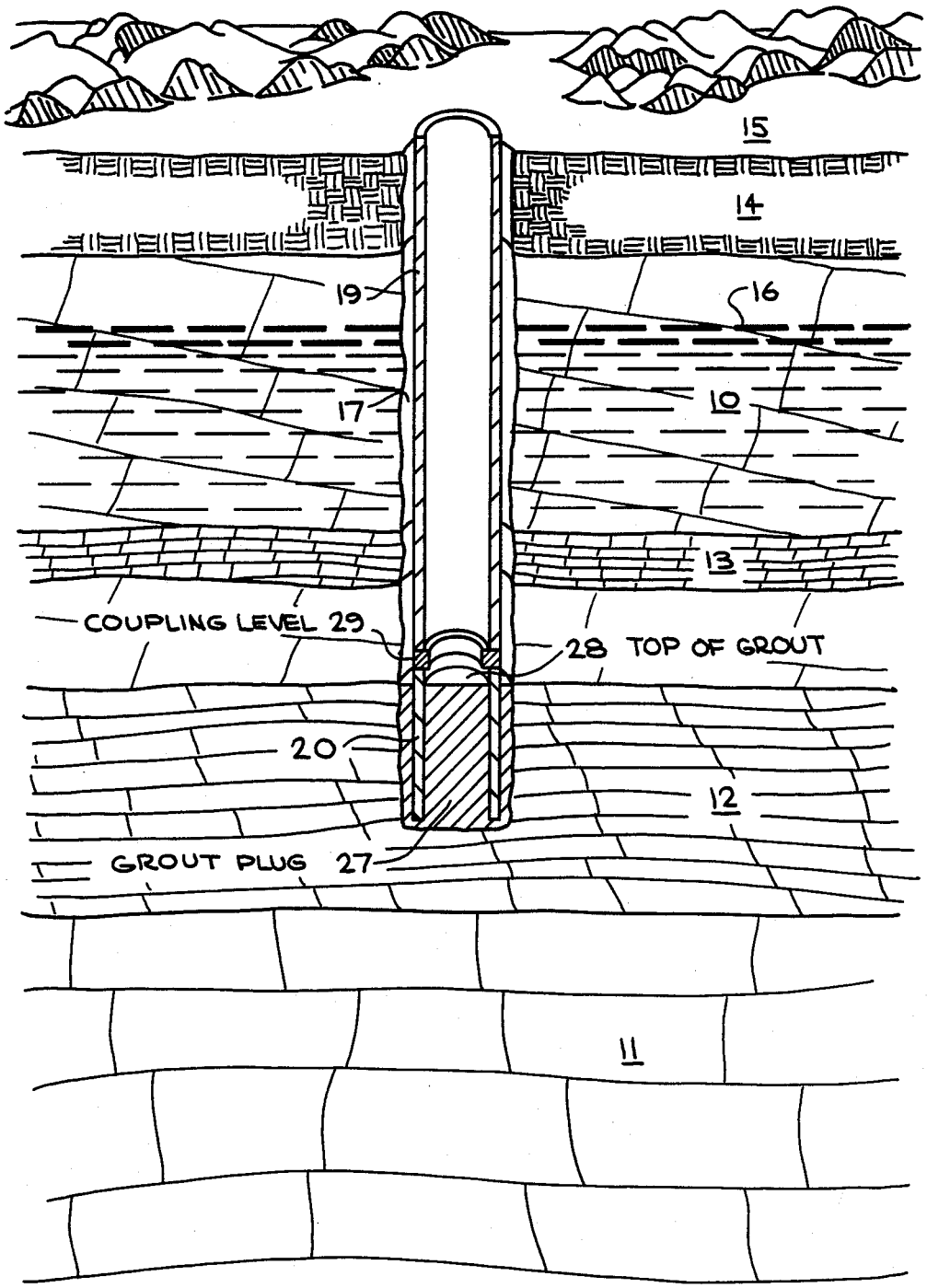

The next operational step is illustrated in FIG. 4 wherein a grout plug or seal 27 of gypsum cement, for example, is poured via a tremie pipe (not shown) into the lower end of borehole 17 and allowed to circulate both inside and outside the casing section 20 so as to encase about 6 foot of the 8 foot length of casing section 20 and so that the top of the grout indicated at 28 is below the coupling level 29. The grout plug 27 is allowed to set 2–4 hours, for example.

Figure 5:
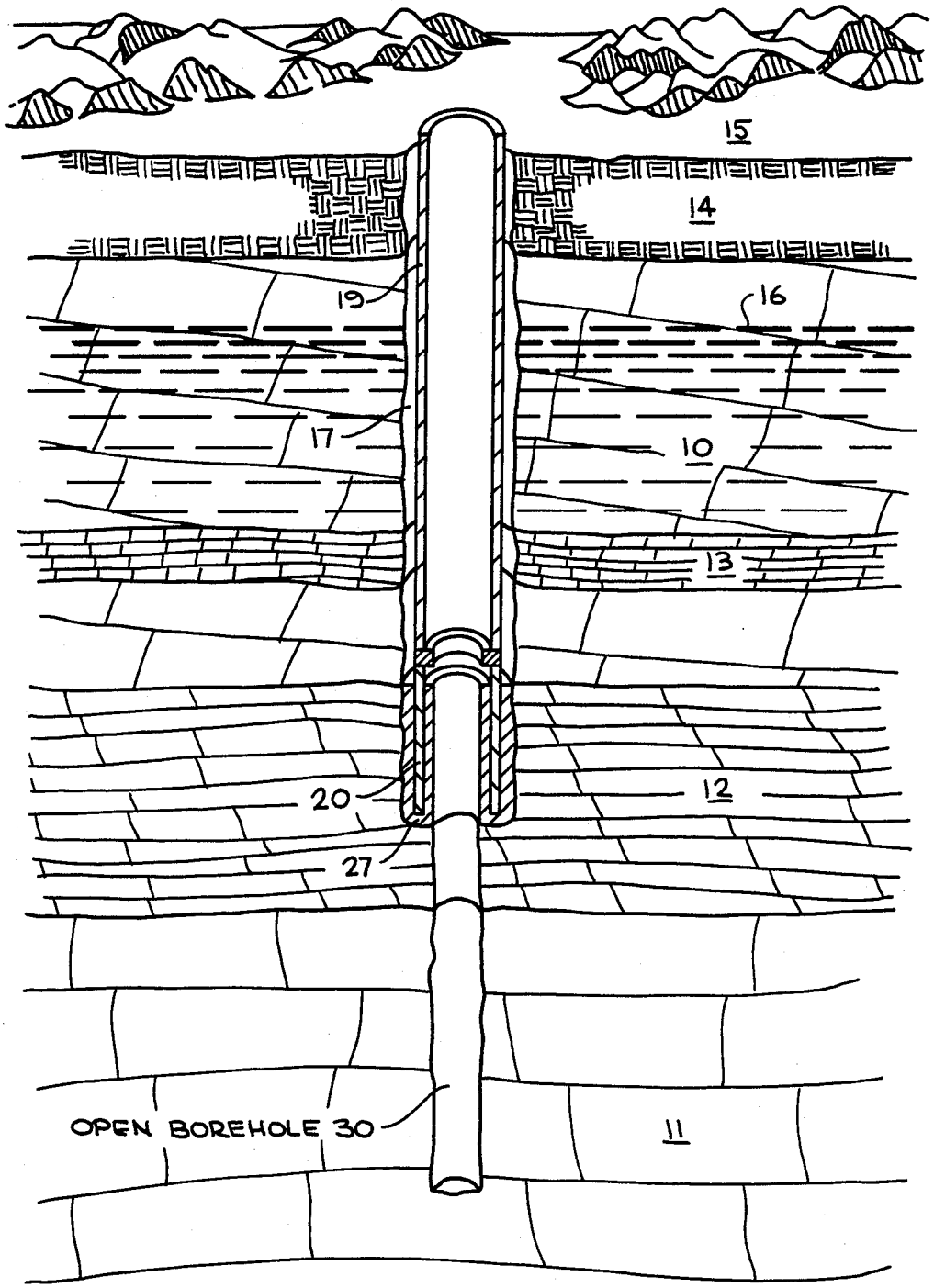

After the grout plug or seal 27 is set, all standing water in the casing 18 is removed by conventional means, such as by pumping, and the well is allowed to stand for one to two hours, for example, to determine whether there are any leaks in the casing 18 or the grout plug 27 to insure that there will be no cross migration of waters. Once it has been determined that there are no leaks, a borehole 30, having a diameter of 3.78 inches, for example, is drilled through grout plug 27, through the remaining portion of confining layer 12, and into the lower or confined aquifer 11 to a desired depth, as illustrated in FIG. 5. If desired, drilling of borehole 30 can be briefly stopped after drilling through grout plug 27 to assure that such drilling has not caused a water leak.

When the total depth of the borehole is reached, drilling tools are removed from the borehole and geophysical logs can be run on the bottom section of the borehole 30. These can include natural gamma, gamma-gamma density, self-potential, resistivity and caliper logs.

It is recognized that if, for a desired application, only the lower confined aquifer 11 is to be utilized for some purpose other than for instrumentation described hereinafter, the method thus far described illustrates how the lower aquifer can be reached by drilling through an upper aquifer without any cross migration of the waters of the two aquifers. Thus, the lower aquifer has effectively been isolated from the upper aquifer.

Figure 6:
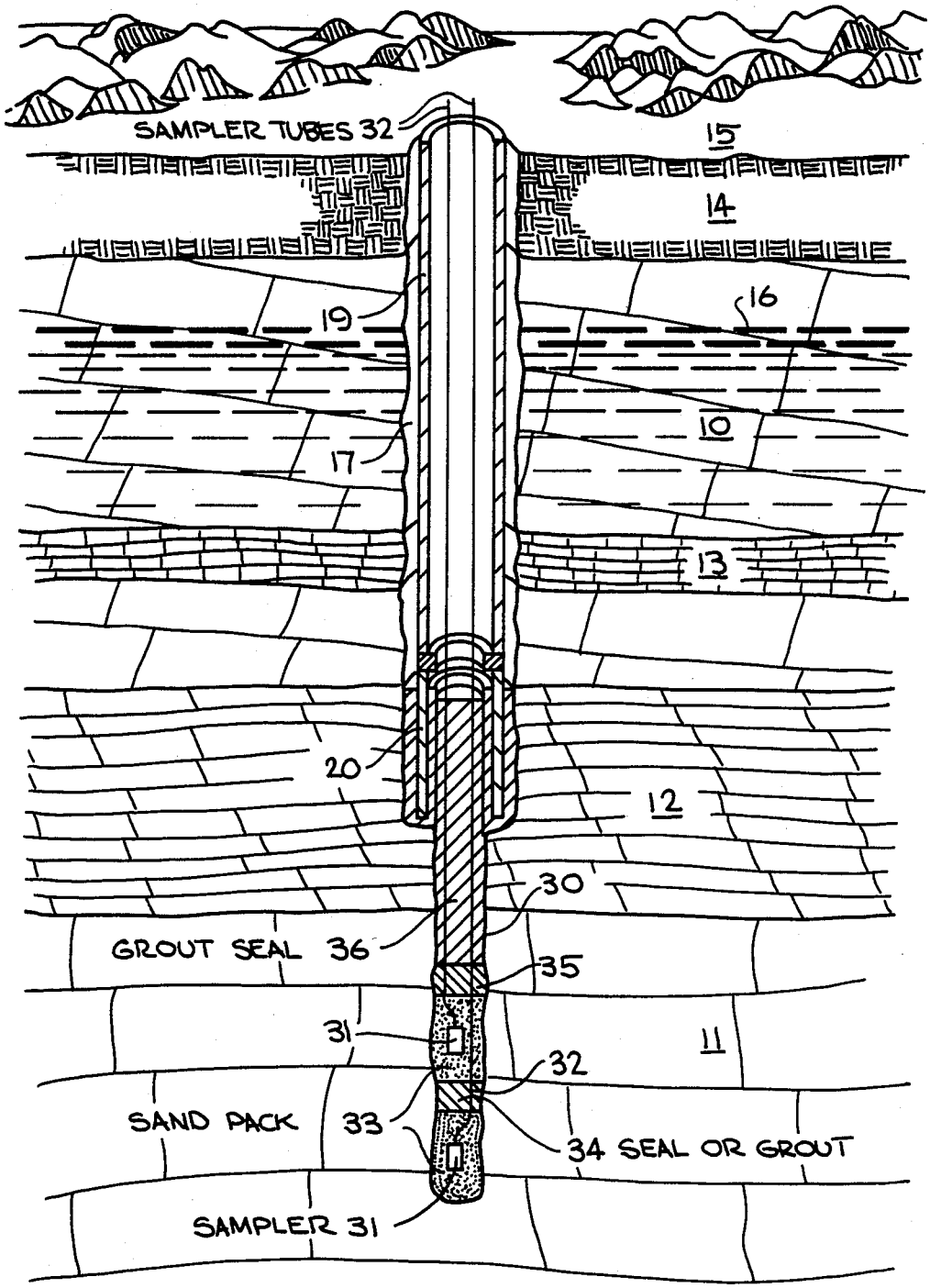

The next operational sequence of the method involves the placement of desired instrumentation in the lower section of borehole 30 to enable monitoring of the confined aquifer 11. This, for example, may be accomplished, as illustrated in FIG. 6, by placing instruments such as gas lift samplers 31 in borehole 30 with vibrating wire pressure transducers (not shown) placed adjacent each sampler 31 and with the transducer cables (not shown) and sampler tubes 32 from samplers 31 extending upwardly through bore hole 30 and casing 18 to ground surface 15. Appropriate grout and sand is then placed below, around and in between the samplers 31 by a tremie pipe. While the samplers, etc. may be individually placed in the lower section of the borehole 30, an entire instrumentation package may be assembled on the ground surface and tested for proper operation before being lowered into the bottom of borehole 30. For example, the instrumentation package may contain the samplers 31 and attached transducers in a polypropylene filter "sock" with #3 sand, as indicated at 33, packed therearound, and a bentonite seal or grout 34 is located between the samplers 31 and another bentonite seal or grout 35 is located above the upper sampler. Above-referenced report UCRL-89440 illustrates in FIG. 6 thereof such an instrument package. Prior to lowering the instrumentation (sampler-transducer assembly) package, a tremie pipe may be lowered into borehole 30 and a footing of #3 sand, for example, placed on the bottom of the borehole. Also, after the instrumentation package has been placed on the sand footing, #3 sand is placed in the borehole through the tremie pipe to completely cover the package. It is recognized that the sand quantities will vary based on the vertical area of the borehole to be open to sampling. If desired the filter "sock" may include a cap (2 feet in height) of fine sand (#0 sand) placed on top of the #3 sand to prevent the bentonite seals or grout 34 and 35 from intruding into the #3 sand. The bentonite seals 34 and 35 may be of $\frac{3}{8}$ inch bentonite pellets with a height of 5 feet.

After the sampler-transducer assembly (instrumentation package) is located in the bottom of borehole 30, the borehole is provided with a grout seal, such as gypsum cement for example, back to the top of grout plug 27, as indicated at 36 in FIG. 6. The grout seal or plug 36 is allowed to cure (2–4 hours, for example) before any further work is performed.

Figure 7:
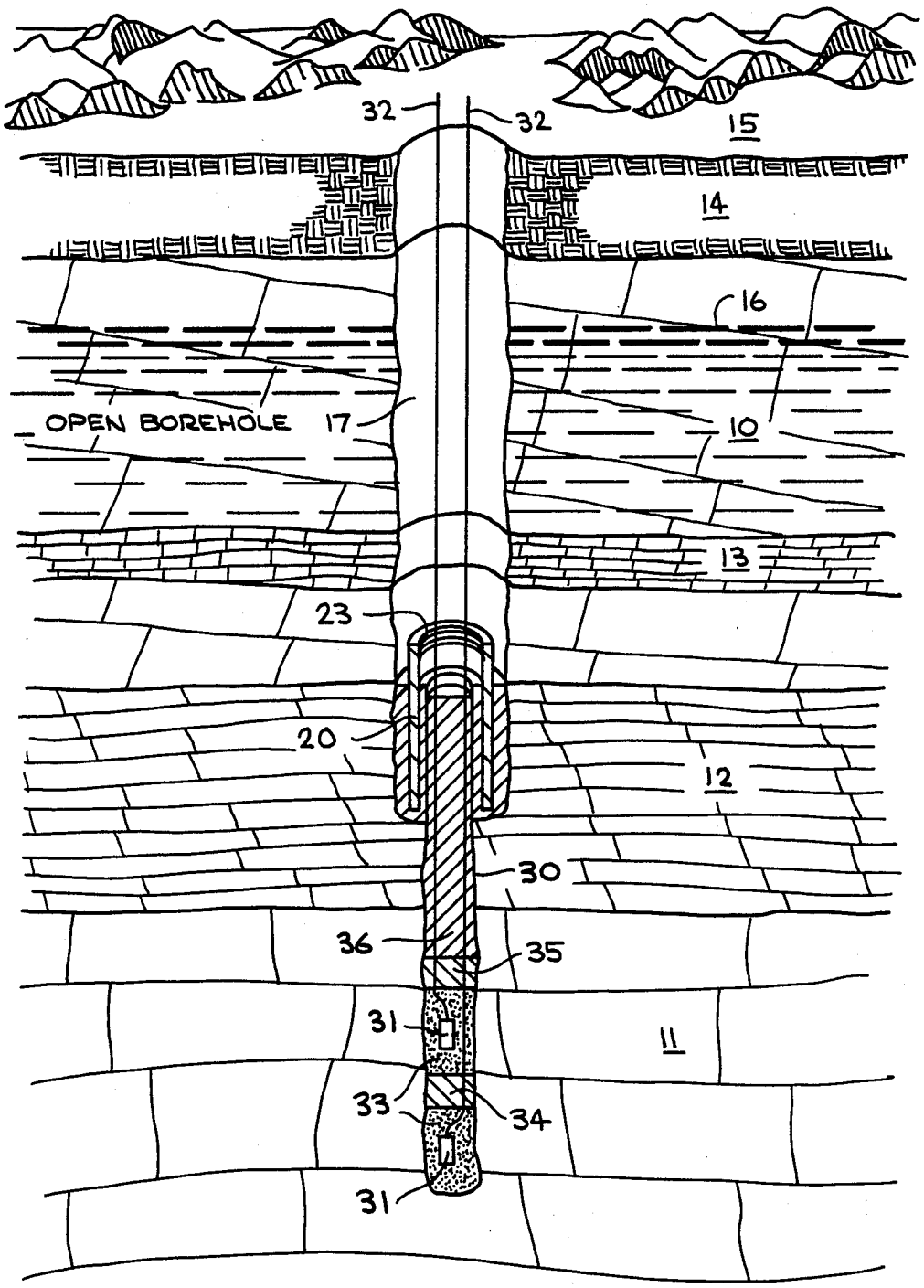

After the grout seal or plug 36 has cured, any standing water in casing 18 is removed and the borehole is monitored for one hour, for example, to determine if there is any leakage from the lower aquifer 11 into casing 18. When it has been determined that there are no leaks, the next operational sequence is to remove the casing section 19 from borehole 17. Removing of casing section 19 is accomplished by turning the entire casing string and coupling 21 to the right (clockwise), which causes unscrewing of the left hand threaded section 25 of coupling 21 from threaded section 23 of casing section 20, and removing the casing section 19 from borehole 17, as shown in FIG. 7. The sampler tubes 32 remain extending upwardly through open borehole 17.

Figure 8:
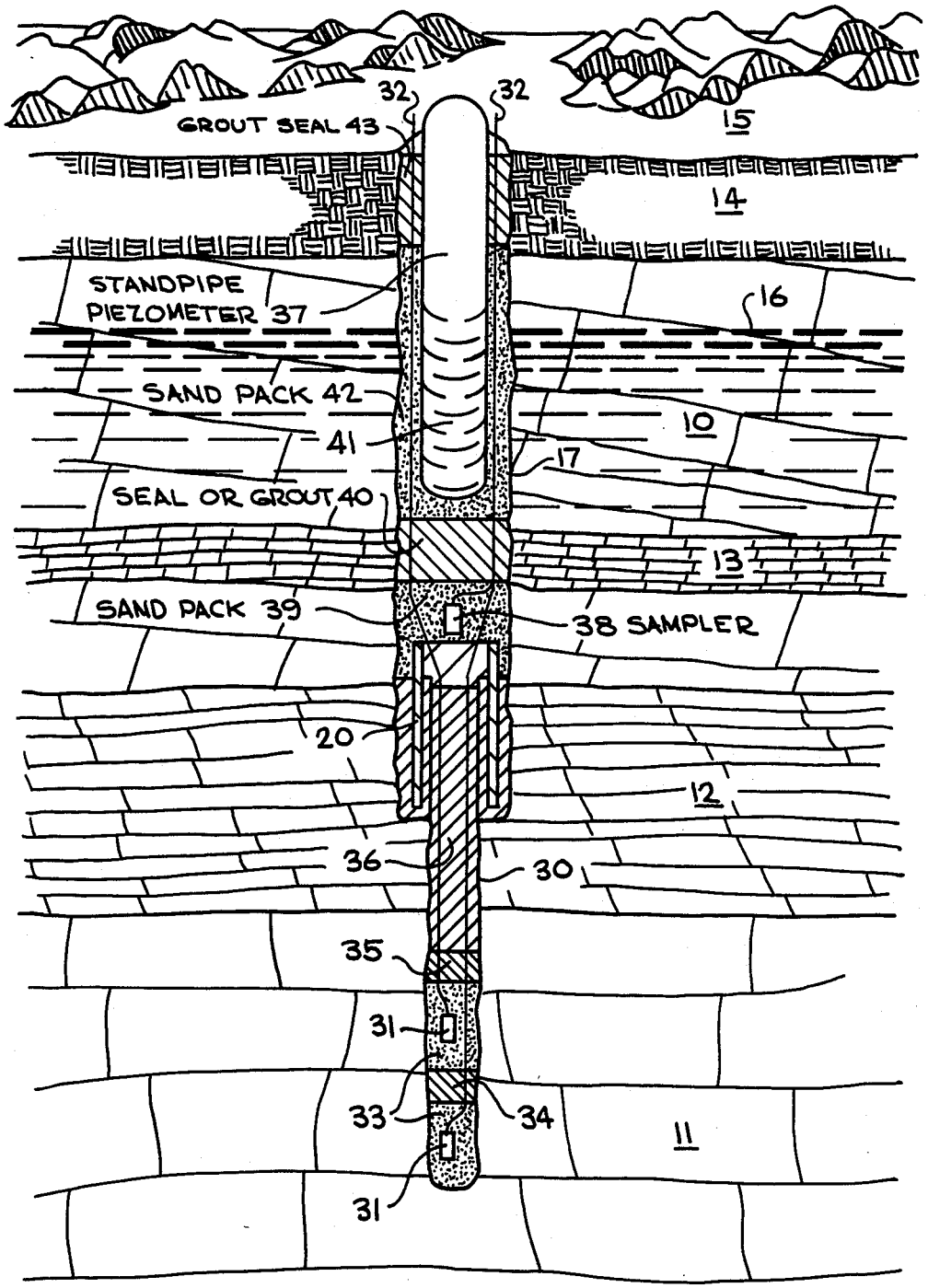

The upper part of borehole 17 is now open to the formations 10, 13 and 14, and can now be instrumented and grouted as described below and illustrated in FIG. 8. The instrumentation in upper aquifer 10 is completed in a similar fashion as the lower aquifer 11 except that a stand pipe piezometer 37 is installed as an upper most sampling point. A sampler 38, equipped with a transducer and connected via a sampler tube similar to samplers 31, is located in the lower portion of borehole 17 with a sand pack 39 located thereabout with a bentonite seal or grout 40 located above sand pack 39. The standpipe piezometer 37 includes a casing of PVC material with square threads and flush joints interconnecting lengths thereof. No glues or solvents need be used during its assembly. The casing of standpipe piezometer 37 includes a horizontally slotted lower end section indicated at 41. The section 41 of the slotted casing is a 5 foot length with 0.020 slot width, for example. Also, the piezometer 37 includes 5 foot casing sections, for example, extending upwardly from the top of slotted section 41. The screened section was then sand packed as indicated at 42. The borehole 17 is then grouted as indicated at 43, such as by gypsum, to the ground surface 15. Thus, the subsurface preparation of the borehole is now completed.

The sampler tubes 32 and signal transmission cables from the transducers are connected to appropriate monitoring apparatus, not shown, which does not constitute part of this invention.

It has thus been shown that the present invention provides a cost effective method by which separate aquifers are isolated and/or individually instrumented within a single borehole, without cross migration of the waters in the separate aquifers. The use of a single borehole achieves a considerable cost savings.

While particular procedures, apparatus, materials, and parameters have been set forth by way of describing the method of this invention, such are not intended to be limiting, and modification will become apparent to those skilled in the art. It is intended to cover in the appended claims all such modification that come within the scope of this invention.

I claim:

1. A method for individually instrumenting at least a pair of aquifers separated by a confining bed, comprising the steps of:

drilling a borehole from the ground surface through an upper of the pair of aquifers and into the confining bed;

emplacing in the borehole a casing having two separatable sections;

grouting the borehole in the vicinity of and within a lower of said two separatable casing sections;

boring a hole through the grout and through the remainder of the confining bed into the lower of the pair of aquifers;

providing a lower section of the borehole in the area of the lower aquifer with instrumentation having signal transmitting and sampling means extending to the ground surface;

grouting a portion of the borehole above the instrumentation up to an upper portion of the lower of said two separatable casing sections;

removing the upper of the two separatable casings from the borehole; and providing at least a section of the borehole adjacent the upper of the pair of aquifers with instrumentation having signal transmitting and sampling means extending to the ground surface.

2. The method of claim 1, additionally including the step of grouting the borehole above the instrumentation located adjacent the upper of the pair of aquifers.

3. The method of claim 1, additionally including the steps of:

providing a coupling between the separatable sections of the casing;

providing the coupling with a pair of threaded sections, each threaded section having threads extending in opposite directions; and providing each of the separatable sections of casing with threaded portions that cooperate with the threaded sections of the coupling.

4. The method of claim 1, additionally including the steps of:

allowing the grouting in the borehole to cure;

removing any water in the casing; and checking for water leaks through the casing and grout, prior to the step of boring a hole through the grout and through the confining bed into the lower of the pair of aquifers.

5. The method of claim 1, wherein the step of instrumenting the borehole in the lower of the pair of aquifers includes the steps of:

providing a quantity of sand in the bottom of the hole;

positioning a sampling device in the borehole above the sand;

supplying sand around and above the sampling device; and providing a seal in the borehole above the sand.

6. The method of claim 1, wherein the step of instrumenting the borehole in the lower of the pair of aquifers is carried out by:

assembling above ground an instrument package;

testing the thus assembled package; and lowering the instrument package into the bottom of the borehole.

7. The method of claim 1, wherein the step of removing the upper of the two separatable casing sections from the borehole is carried out by:

twisting the upper of the two casing sections to disconnect it from the lower of the casing sections; and lifting the upper of the casing sections from the borehole.

8. The method of claim 1, wherein the step providing the upper of the pair of aquifers with instrumentation includes the steps of:

providing the borehole with a quantity of sand;

locating a sampling device above the sand;

supplying sand around and above the sampling device; and providing a seal in the borehole above the sand.

9. The method of claim 8, additionally including the steps of:

positioning a piezometer in the borehole above the sand;

providing a sand pack below and around at least a portion of the piezometer; and filling the borehole above the sand pack with grouting.

10. The method of claim 9, additionally including the steps of:

forming the piezometer as a standpipe piezometer having a casing; and providing a lower portion of the piezometer casing with a slotted section.

11. The method of claim 1, wherein the grouting is carried out by directing grouting material to a desired location via a tremie pipe.

12. A method for drilling into and isolating two spaced aquifers using a single drill hole without cross migration of the waters of the aquifers, comprising the steps of:

drilling a borehole from the ground surface through one of the aquifers and into an area separating the two aquifers:

emplacing a casing having separatable sections in the borehole;

providing the bottom of the borehole with grout around and within a lower portion of a lower of the separatable sections of the casing;

drilling a hole through the grout, through the area separating the two aquifers, and into the other of the two aquifers;

providing at least a lower section of the borehole in at least the area of the lower aquifer with instrumentation having signal transmitting and sampling means extending to the ground surface;

grouting a portion of the borehole above the instrumentation; and removing the upper of the two separatable casings from the borehole.

13. The method of claim 12, additionally including the step interconnecting the separatable sections of casing via a coupling.

14. The method of claim 13, additionally including the steps of:

providing the coupling with a pair of oppositely threaded end sections; and providing each of the separatable sections of casing with a threaded end section which cooperates with the threaded end sections of said coupling.

15. The method of claim 14, wherein the upper threaded end section of the coupling has right hand threads, wherein the lower threaded end section of the coupling has left hand threads, and wherein the separatable sections of casing are separated by turning the upper of said sections in a clockwise direction.

* * * * *